US010511078B2

(12) United States Patent
Peng et al.

(10) Patent No.: US 10,511,078 B2
(45) Date of Patent: Dec. 17, 2019

(54) ANTENNA SYSTEM

(71) Applicant: Wistron NeWeb Corp., Hsinchu (TW)

(72) Inventors: Huang-Tse Peng, Hsinchu (TW); Hsiang-Feng Hsieh, Hsinchu (TW); Wan-Ju Huang, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 114 days.

(21) Appl. No.: 15/863,613

(22) Filed: Jan. 5, 2018

(65) Prior Publication Data

US 2018/0212304 A1 Jul. 26, 2018

Related U.S. Application Data

(60) Provisional application No. 62/449,113, filed on Jan. 23, 2017.

(30) Foreign Application Priority Data

Nov. 22, 2017 (TW) ..... 106140531 A

(51) Int. Cl.

| | |
|---|---|
| ***H01Q 3/24*** | (2006.01) |
| ***H01Q 1/22*** | (2006.01) |
| ***H01Q 21/22*** | (2006.01) |
| ***H01Q 9/38*** | (2006.01) |
| ***H01Q 3/34*** | (2006.01) |

(52) U.S. Cl.

CPC ..... *H01Q 1/2258* (2013.01); *H01Q 3/24* (2013.01); *H01Q 3/34* (2013.01); *H01Q 9/38* (2013.01); *H01Q 21/22* (2013.01)

(58) Field of Classification Search

CPC ..... H01Q 1/2258; H01Q 1/2266; H01Q 3/24; H01Q 3/34; H01Q 9/0442; H01Q 9/38; H01Q 21/22

See application file for complete search history.

(56) References Cited

U.S. PATENT DOCUMENTS

2007/0176836 A1* 8/2007 Abramov ..... H01Q 1/2291 343/702

FOREIGN PATENT DOCUMENTS

| | | |
|---|---|---|
| CN | 105742791 A | 7/2016 |
| CN | 103107412 B | 3/2017 |
| WO | 2016/155076 A1 | 10/2016 |

* cited by examiner

*Primary Examiner* — Graham P Smith

(74) *Attorney, Agent, or Firm* — McClure, Qualey & Rodack, LLP

(57) ABSTRACT

An antenna system includes at least a first tunable antenna. The first tunable antenna includes a first radiation element, a second radiation element, a transmission line, and a switch circuit. The transmission line includes a first segment, a second segment, and a phase-adjustment segment. The first radiation element is coupled through the first segment to a first feeding point. The second radiation element is coupled through the second segment to a second feeding point. The switch circuit is configured to switch between the first feeding point and the second feeding point, so that the first feeding point or the second feeding point is arranged for receiving a feeding signal. The phase-adjustment segment has a first end and a second end. The first feeding point is positioned at the first end of the phase-adjustment segment. The second feeding point is positioned at the second end of the phase-adjustment segment.

18 Claims, 9 Drawing Sheets

ANTENNA SYSTEM

CROSS REFERENCE TO RELATED APPLICATIONS

This application claims the benefit of U.S. Provisional Application No. 62/449,113, filed on Jan. 23, 2017, the entirety of which is incorporated by reference herein. This application further claims priority of Taiwan Patent Application No. 106140531 filed on Nov. 22, 2017, the entirety of which is incorporated by reference herein.

BACKGROUND OF THE INVENTION

Field of the Invention

The disclosure generally relates to an antenna system, and more particularly, it relates to an antenna system for generating different radiation patterns.

Description of the Related Art

With the advancements being made in mobile communication technology, mobile devices such as portable computers, mobile phones, multimedia players, and other hybrid functional portable electronic devices have become more common. To satisfy consumer demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and using frequency bands of 2.4 GHz, 5.2 GHz, and 5.8 GHz.

Antennas are indispensable elements to mobile devices supporting wireless communications. However, in general an antenna can usually only generate a fixed radiation pattern. If the signal reception direction is aligned with a null of the antenna radiation pattern, it may face problems with reduced data transmission rates and poor communication quality. Accordingly, there is a need to propose a novel solution for solving the problems of the prior art.

BRIEF SUMMARY OF THE INVENTION

In an exemplary embodiment, the disclosure is directed to an antenna system including a first tunable antenna. The first tunable antenna includes a first radiation element, a second radiation element, a transmission line, and a switch circuit. The transmission line includes a first segment, a second segment, and a phase-adjustment segment. The first radiation element is coupled through the first segment to a first feeding point. The second radiation element is coupled through the second segment to a second feeding point. The switch circuit is configured to switch between the first feeding point and the second feeding point, so that the first feeding point or the second feeding point is arranged for receiving a feeding signal. The phase-adjustment segment has a first end and a second end. The first feeding point is positioned at the first end of the phase-adjustment segment. The second feeding point is positioned at the second end of the phase-adjustment segment.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1:
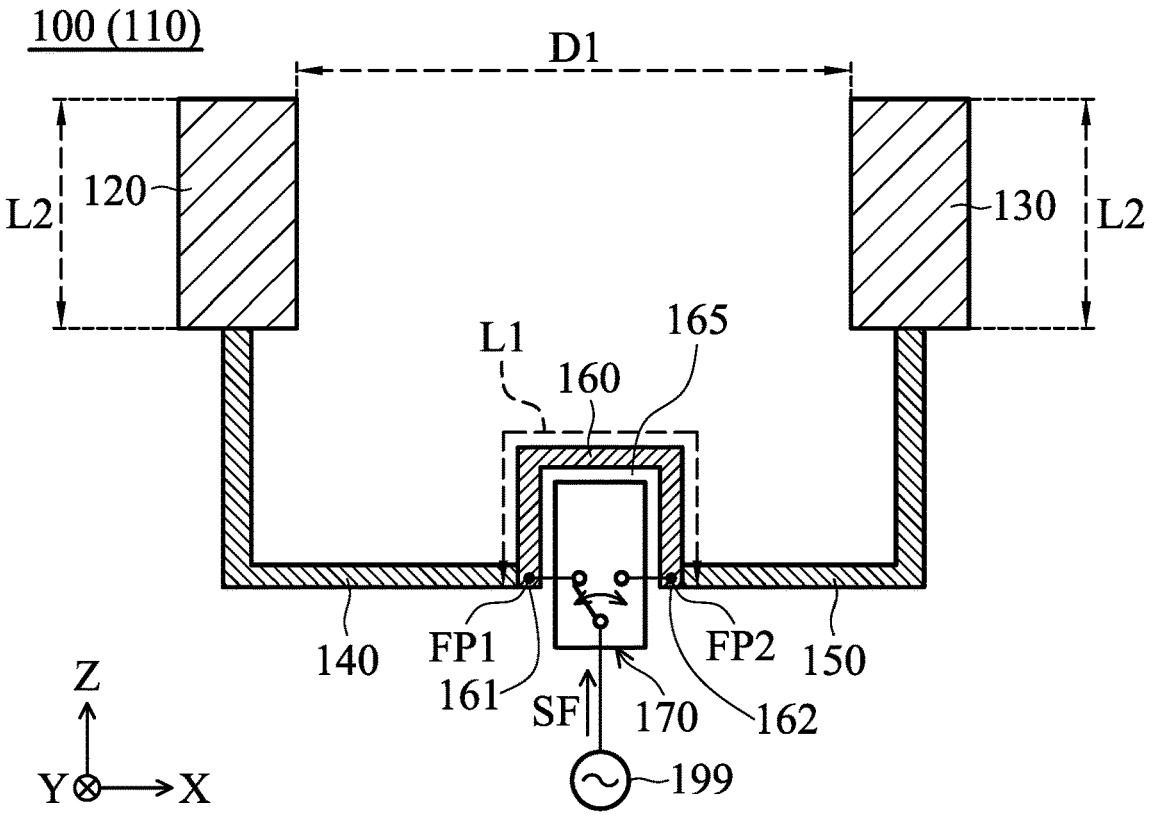
FIG. 1 is a diagram of an antenna system according to an embodiment of the invention.

FIG. 1 is a diagram of an antenna system 100 according to an embodiment of the invention. The antenna system 100 may be applied in a mobile device, such as a smartphone, a tablet computer, or a notebook computer. As shown in FIG. 1, the antenna system 100 at least includes a first tunable antenna 110. The first tunable antenna 110 includes a first radiation element 120, a second radiation element 130, a transmission line, and a switch circuit 170. The aforementioned transmission line includes a first segment 140, a second segment 150, and a phase-adjustment segment 160.

The first radiation element 120, the second radiation element 130, the first segment 140, the second segment 150, and the phase-adjustment segment 160 may be made of conductive materials, such as metal materials. It should be understood that the shapes and types of the first radiation element 120, the second radiation element 130, the first segment 140, the second segment 150, and the phase-adjustment segment 160 are not limited in the invention. For example, both of the first radiation element 120 and the second radiation element 130 may form a monopole antenna, a dipole antenna, a patch antenna, or a chip antenna. The aforementioned transmission line (including the first segment 140, the second segment 150, and the phase-adjustment segment 160) may be a microstrip line, a strip-line, or a CPW (Coplanar Waveguide).

The first tunable antenna 110 has a first feeding point FP1 and a second feeding point FP2. Each of the first radiation element 120 and the second radiation element 130 may substantially have a straight-line shape or a rectangular shape. The first radiation element 120 is coupled through the first segment 140 to the first feeding point FP1. The second radiation element 130 is coupled through the second segment 150 to the second feeding point FP2. The phase-adjustment segment 160 is positioned between the first feeding point FP1 and the second feeding point FP2. The phase-adjustment segment 160 is configured to change the feeding phases relative to the first radiation element 120 and the second radiation element 130. Specifically, the phase-adjustment segment 160 has a first end 161 and a second end 162. The first feeding point FP1 is positioned at the first end 161 of the phase-adjustment segment 160. The second feeding point FP2 is positioned at the second end 162 of the phase-adjustment segment 160. The switch circuit 170 is configured to switch between the first feeding point FP1 and the second feeding point FP2, such that either the first feeding point FP1 or the second feeding point FP2 is arranged for receiving a feeding signal SF. A signal source 199 may be an RF (Radio Frequency) module for generating the feeding signal SF or processing a reception signal. The signal source 199 is coupled through the switch circuit 170 to either the first feeding point FP1 or the second feeding point FP2, so as to excite the first tunable antenna 110. In some embodiments, the phase-adjustment segment 160 substantially has an inverted U-shape, and the switch circuit 170 is at least partially disposed in a notch 165 of the inverted U-shape of the phase-adjustment segment 160, thereby reducing the total size of the first tunable antenna 110. In alternative embodiments, the phase-adjustment segment 160 has a different shape, such as a straight-line shape, a W-shape, or a C-shape. By switching between the first feeding point FP1 and the second feeding point FP2, the first tunable antenna 110 can generate different radiation patterns due to the changes in feeding phases, and therefore it can receive or transmit wireless signals in a variety of directions.

In some embodiments, the antenna system 100 covers an operation frequency band from 5150 MHz to 5875 MHz, so as to support the application of WLAN (Wireless Local Area Networks) 5 GHz. It should be noted that the aforementioned operation frequency band is adjustable in response to different requirements. In some embodiments, the element sizes of the antenna system 100 are as follows. The length L1 of the phase-adjustment segment 160 may be equal to 0.25 wavelength ($\lambda/4$) of the central frequency of the operation frequency band, so as to provide a feeding phase difference which is almost equal to 90 degrees. Since the switch circuit 170 can contribute a little feeding phase difference, the length L1 of the phase-adjustment segment 160 may be slightly shorter than 0.25 wavelength ($\lambda/4$) of the central frequency of the operation frequency band in other embodiments. The distance D1 between the first radiation element 120 and the second radiation element 130 may be substantially equal to 0.25 wavelength ($\lambda/4$) of the central frequency of the operation frequency band. The length L2 of each of the first radiation element 120 and the second radiation element 130 may be substantially equal to 0.25 wavelength ($\lambda/4$) of the central frequency of the operation frequency band. The above ranges of element sizes are calculated and obtained according to many experiment results, and they help to optimize the radiation pattern and the impedance matching of the antenna system 100.

Figure 2:
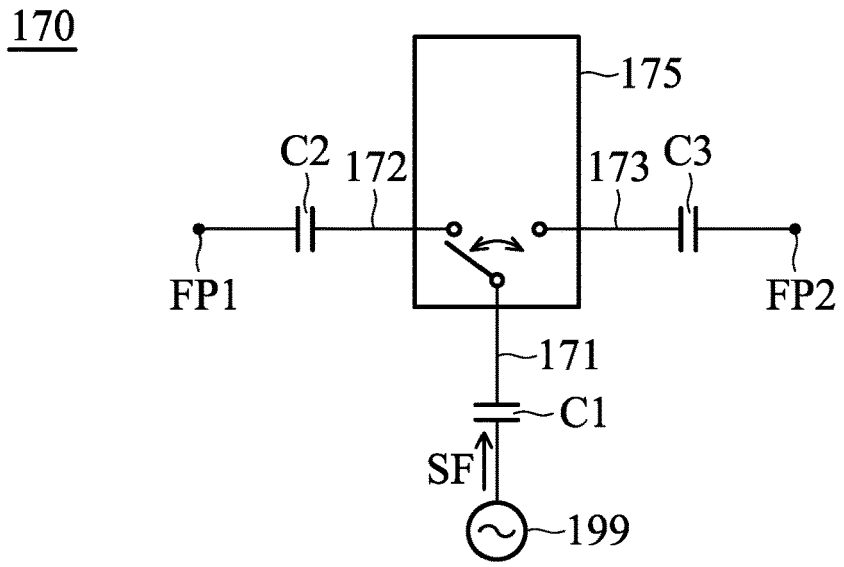
FIG. 2 is a diagram of a switch circuit according to an embodiment of the invention.

FIG. 2 is a diagram of the switch circuit 170 according to an embodiment of the invention. In the embodiment of FIG. 2, the switch circuit 170 at least includes a SPDT (Single Port Double Throw) switch 175 which has a common terminal 171, a first terminal 172, and a second terminal 173. The common terminal 171 of the SPDT switch 175 is coupled to the signal source 199. The first terminal 172 of the SPDT switch 175 is coupled to the first feeding point FP1. The second terminal 173 of the SPDT switch 175 is coupled to the second feeding point FP2. In some embodiments, the switch circuit 170 further includes a first capacitor C1, a second capacitor C2, and a third capacitor C3. Specifically, the first capacitor C1 is coupled between the signal source 199 and the common terminal 171 of the SPDT switch 175; the second capacitor C2 is coupled between the first feeding point FP1 and the first terminal 172 of the SPDT switch 175; the third capacitor C3 is coupled between the second feeding point FP2 and the second terminal 173 of the SPDT switch 175. The first capacitor C1, the second capacitor C2, and the third capacitor C3 are configured to block DC (Direct Current) noise and prevent it from entering the first radiation element 120 and the second radiation element 130. In alternative embodiments, the first capacitor C1, the second capacitor C2, and the third capacitor C3 are removed, and each of them is replaced with a short-circuited path, such that the SPDT switch 175 is directly connected to the signal source 199, the first feeding point FP1, and the second feeding point FP2.

Figure 3A:
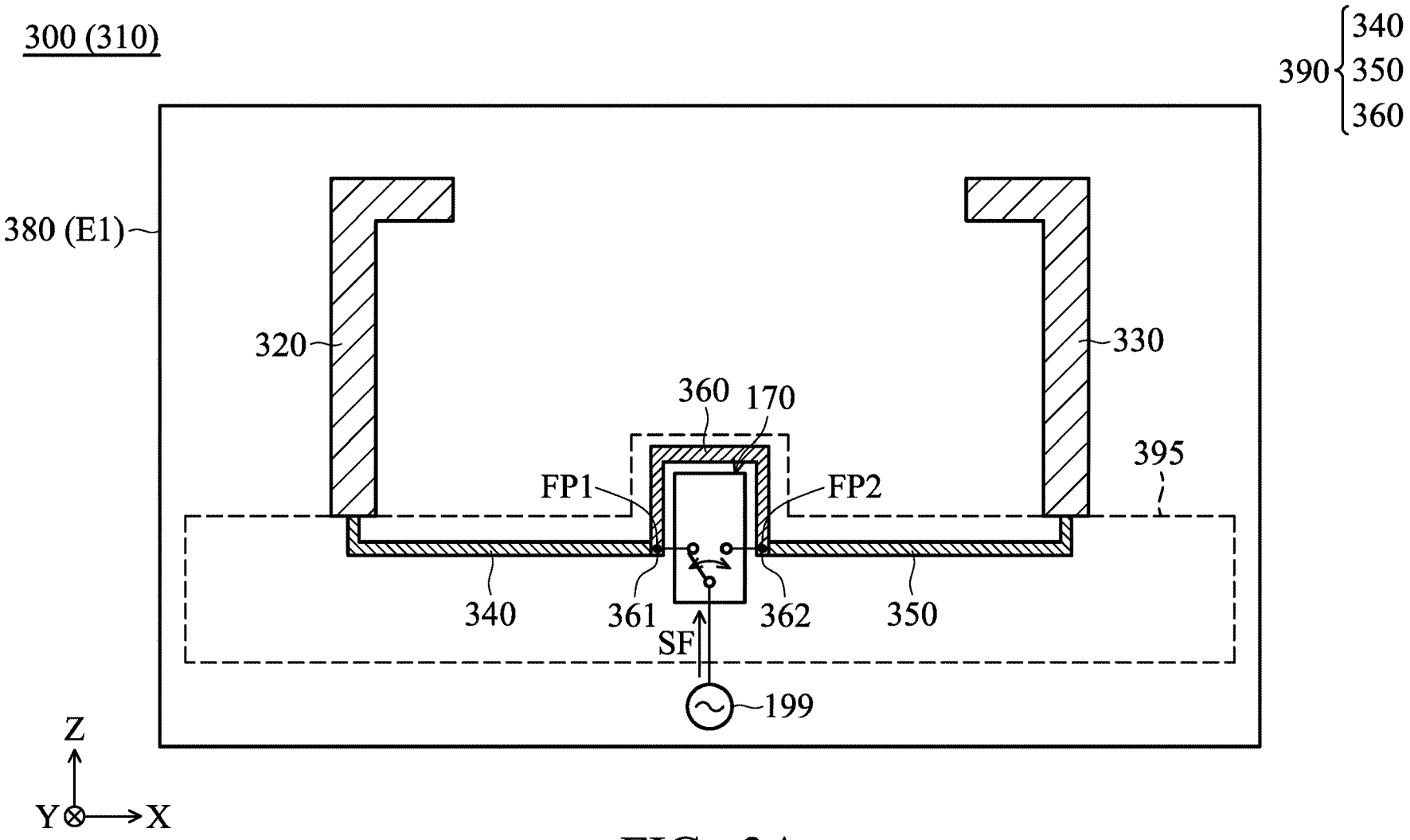
FIG. 3A is a front view of an antenna system according to an embodiment of the invention.
Figure 3B:
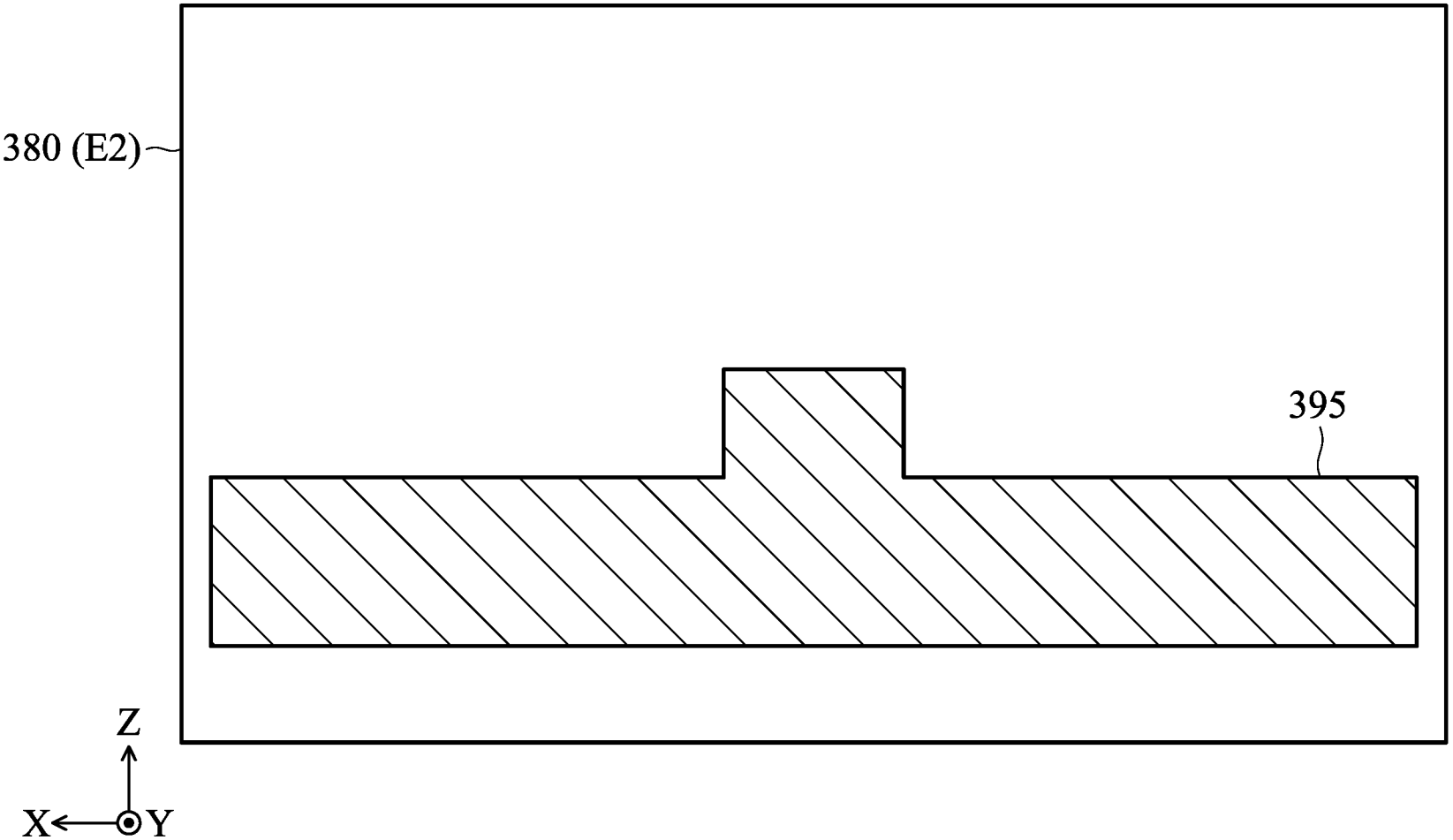
FIG. 3B is a back view of an antenna system according to an embodiment of the invention.

FIG. 3A is a front view of an antenna system 300 according to an embodiment of the invention. FIG. 3B is a back view of the antenna system 300 according to an embodiment of the invention. FIG. 3A and FIG. 3B are similar to FIG. 1, and they may be considered as a practical circuit layout of the antenna system 100. In the embodiment of FIG. 3A and FIG. 3B, the antenna system 300 includes a first tunable antenna 310. The first tunable antenna 310 includes a first radiation element 320, a second radiation element 330, a transmission line, and a switch circuit 170. The aforementioned transmission line includes a first segment 340, a second segment 350, and a phase-adjustment segment 360. The phase-adjustment segment 360 has a first end 361 and a second end 362. The first radiation element 320 is coupled through the first segment 340 to a first feeding point FP1 at the first end 361 of the phase-adjustment segment 360. The second radiation element 330 is coupled through the second segment 350 to a second feeding point FP2 at the second end 362 of the phase-adjustment segment 360. The structures and functions of the switch circuit 170 and the signal source 199 have been described in the embodiments of FIG. 1 and FIG. 2.

Specifically, the first tunable antenna 310 further includes a dielectric substrate 380, a metal trace 390, and a ground plane 395. The dielectric substrate 380 has a top surface E1 and a bottom surface E2. The first radiation element 320 and the second radiation element 330 are disposed on the top surface E1 of the dielectric substrate 380. For example, each of the first radiation element 320 and the second radiation element 330 may be an L-shaped metal piece. The first radiation element 320 and the second radiation element 330 may be disposed on the top surface E1 of the dielectric substrate 380. The end of the first radiation element 320 and the end of the second radiation element 330 may extend toward each other. On the other hand, the metal trace 390 is disposed or printed on the top surface E1 of the dielectric substrate 380, and the ground plane 395 is disposed or printed on the bottom surface E2 of the dielectric substrate 380. The metal trace 390 may substantially have a meandering shape. The ground plane 395 may substantially have an inverted T-shape. The metal trace 390 has a vertical projection on the bottom surface E2 of the dielectric substrate 380. The whole vertical projection of the metal trace 390 may be inside the ground plane 395. With such a design, the aforementioned transmission line (including the first segment 340, the second segment 350, and the phase-adjustment segment 360) may be a microstrip line, which is formed by the metal trace 390 and the ground plane 395 together. It should be noted that the shape of the ground plane 395 can be fine-tuned and minimized according to the shapes of the first segments 340, the second segment 350, and the phase-adjustments segment 360. Since the ground plane 395 occupies only a small area of the bottom surface E2 of the dielectric substrate 380, it can prevent the radiation performance of the first radiation element 320 and the second radiation element 330 from being affected by a ground plane that is too large. The antenna system 300 can be implemented using a general manufacturing process of PCB (Printed Circuit Board), and therefore it has the advantages of low complexity and low cost. Other features of the antenna system 300 of FIG. 3A and FIG. 3B are similar to those of the antenna system 100 of FIG. 1. Accordingly, the two embodiments can achieve similar levels of performance.

Figure 4:
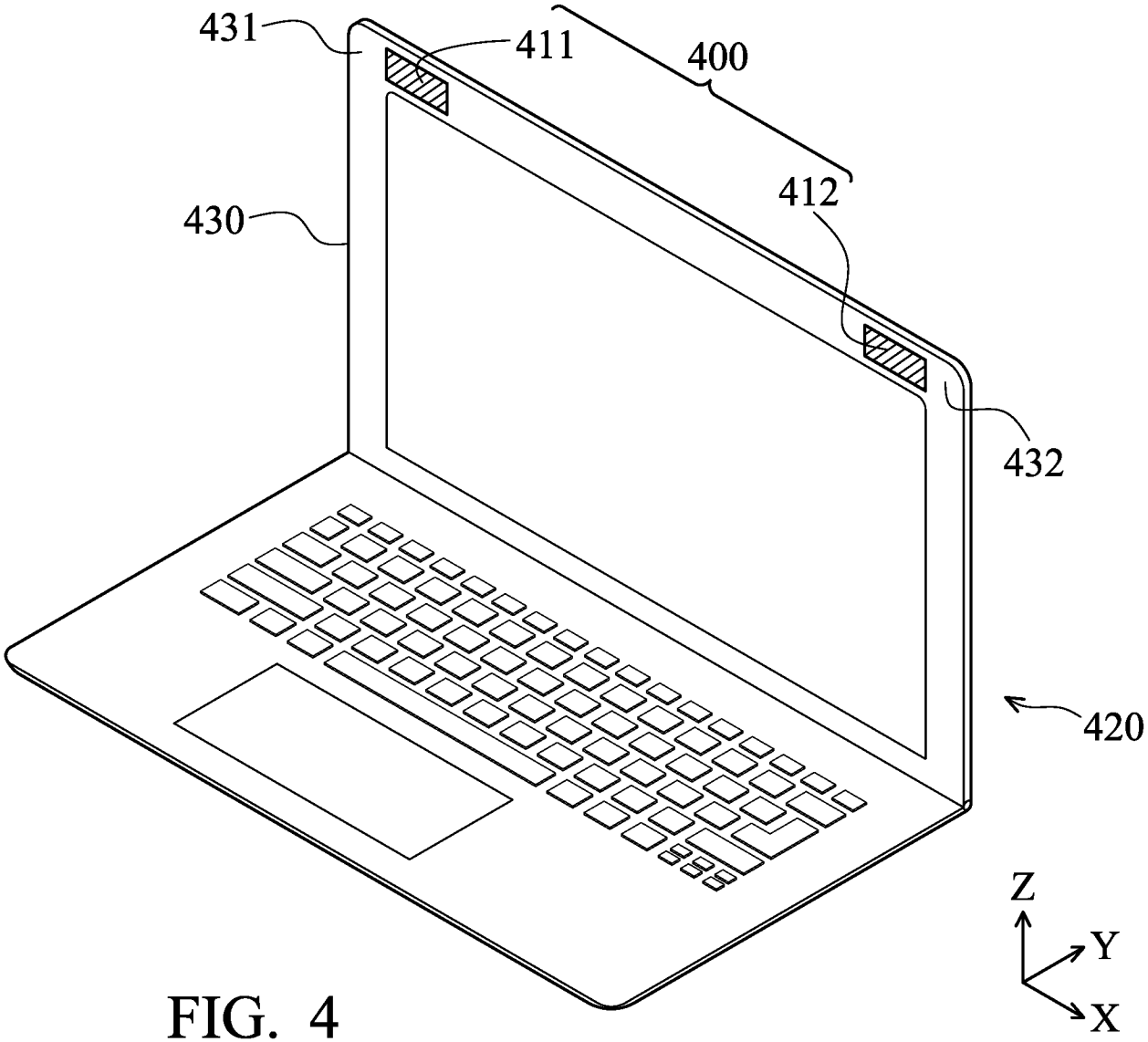
FIG. 4 is a diagram of an antenna system according to an embodiment of the invention.

FIG. 4 is a diagram of an antenna system 400 according to an embodiment of the invention. In the embodiment of FIG. 4, the antenna system 400 includes a first tunable antenna 411 and a second tunable antenna 412, which are applied to a mobile device 420. The second tunable antenna 412 and the first tunable antenna 411 have identical structures. For example, each of the first tunable antenna 411 and the second tunable antenna 412 may have the same structure as that of the first tunable antenna 110 of FIG. 1. Accordingly, the antenna system 400 can support MIMO (Multi-Input and Multi-Output) functions. Specifically, the mobile device 420 may be a notebook computer. The first tunable antenna 411 and the second tunable antenna 412 may be respectively disposed at two opposite corners 431 and 432 of a display device 430 of the mobile device 420 (for example, the first tunable antenna 411 and the second tunable antenna 412 may be disposed parallel to the XZ-plane). Both of the first tunable antenna 411 and the second tunable antenna 412 can generate different synthetic radiation patterns.

Figure 5A:
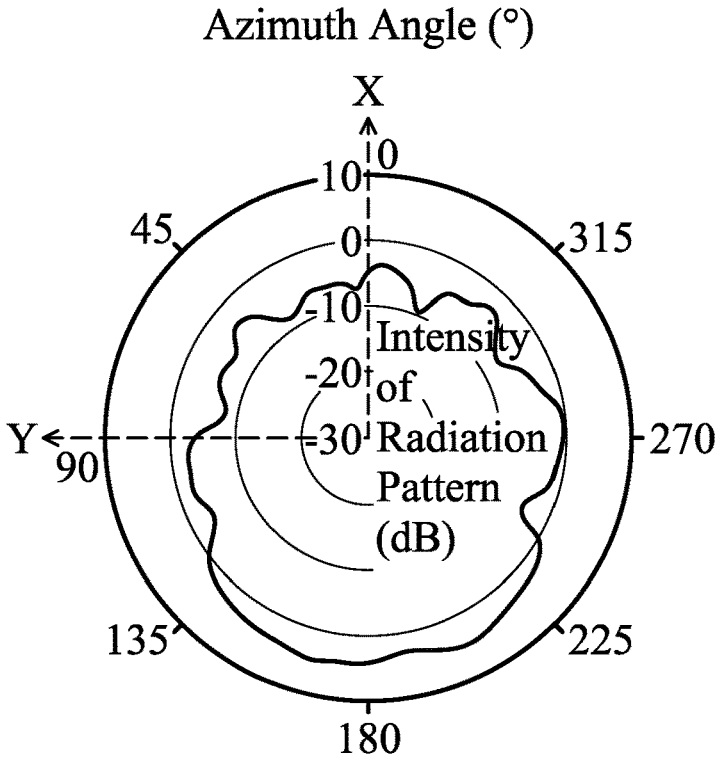
FIG. 5A is a synthetic radiation pattern of an antenna system according to an embodiment of the invention.
Figure 5B:
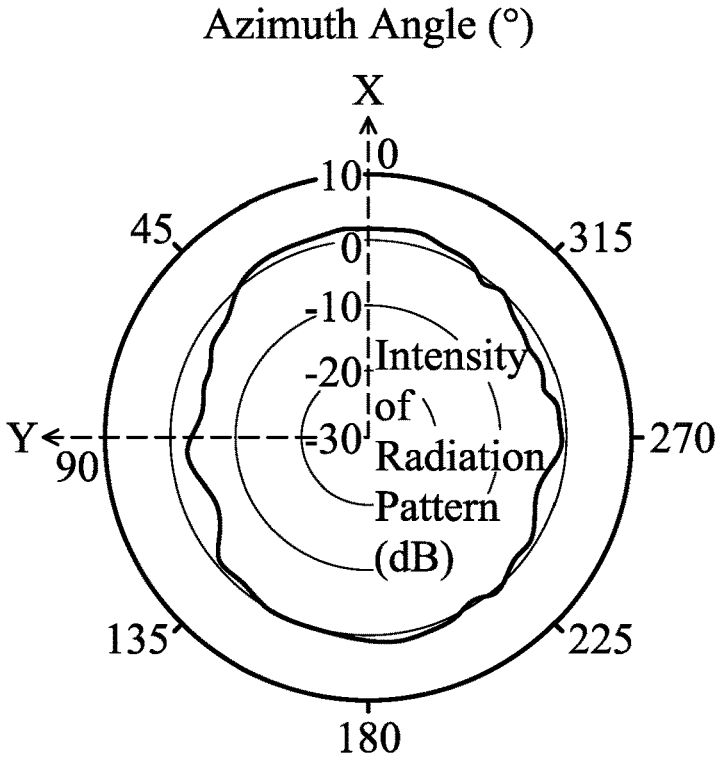
FIG. 5B is a synthetic radiation pattern of an antenna system according to an embodiment of the invention.
Figure 5C:
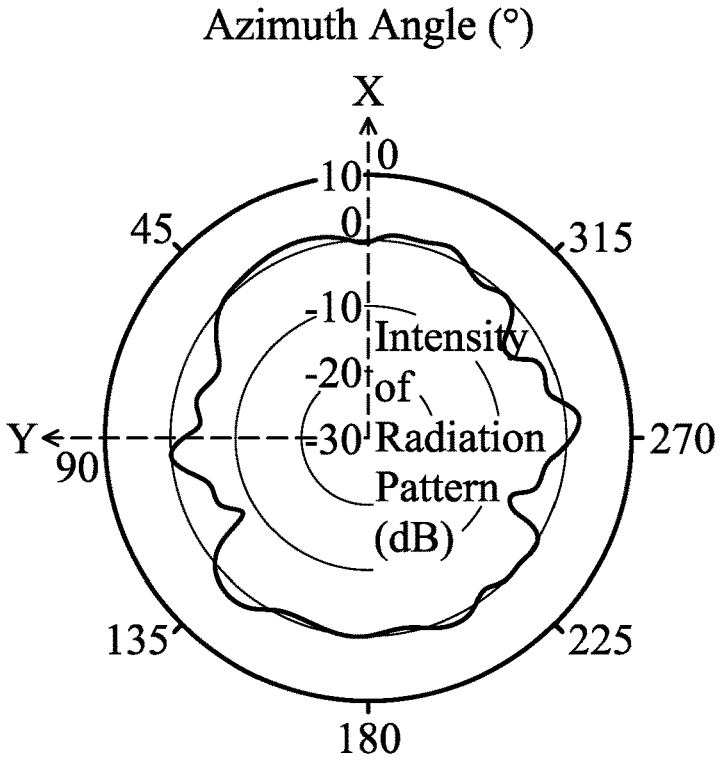
FIG. 5C is a synthetic radiation pattern of an antenna system according to an embodiment of the invention.
Figure 5D:
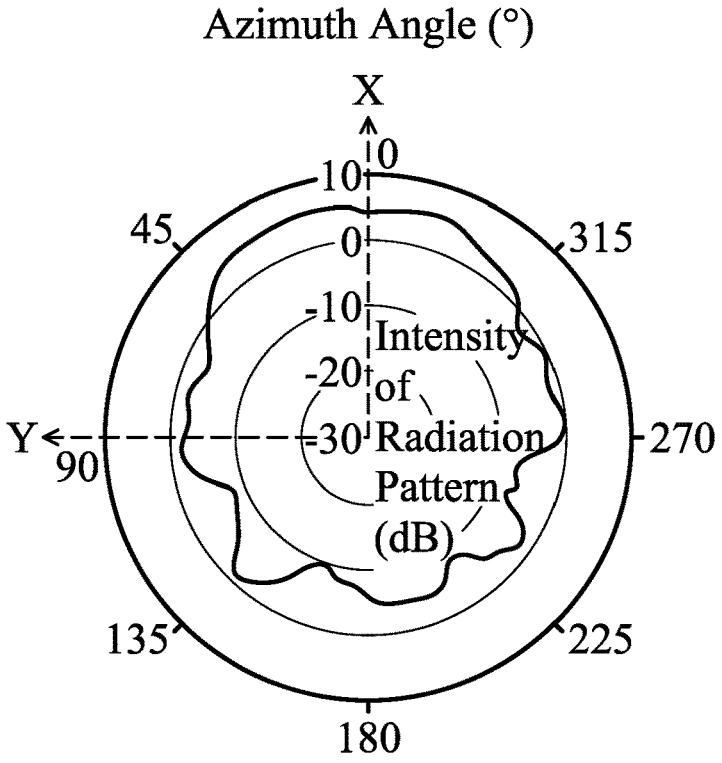
FIG. 5D is a synthetic radiation pattern of an antenna system according to an embodiment of the invention.

FIG. 5A is a synthetic radiation pattern of the antenna system 400 according to an embodiment of the invention, which is measured on the XY-plane. In the embodiment of FIG. 5A, the first tunable antenna 411 switches to its second feeding point, and the second tunable antenna 412 switches to its second feeding point, so as to enhance the intensity of radiation pattern in the direction of the −X axis (or the 180-degree azimuth). FIG. 5B is a synthetic radiation pattern of the antenna system 400 according to an embodiment of the invention, which is measured on the XY-plane. In the embodiment of FIG. 5B, the first tunable antenna 411 switches to its second feeding point, and the second tunable antenna 412 switches to its first feeding point, so as to uniform the intensity of radiation pattern over all directions. FIG. 5C is a synthetic radiation pattern of the antenna system 400 according to an embodiment of the invention, which is measured on the XY-plane. In the embodiment of FIG. 5C, the first tunable antenna 411 switches to its first feeding point, and the second tunable antenna 412 switches to its second feeding point, so as to uniform the intensity of radiation pattern over all directions. FIG. 5D is a synthetic radiation pattern of the antenna system 400 according to an embodiment of the invention, which is measured on the XY-plane. In the embodiment of FIG. 5D, the first tunable antenna 411 switches to its first feeding point, and the second tunable antenna 412 switches to its first feeding point, so as to enhance the intensity of radiation pattern in the direction of the +X axis (or the 0-degree azimuth). According to the measurements of FIGS. 5A to 5D, the antenna system 400 can generate four different synthetic radiation patterns by switching between the first feeding point and the second feeding point of each of the first tunable antenna 411 and the second tunable antenna 412 (whose practical structures may be the same as that of the first tunable antenna 110 of FIG. 1). It should be noted that the invention is not limited to the above. In other embodiments, the antenna system 400 includes more tunable antennas for generating more different synthetic radiation patterns.

Figure 6:
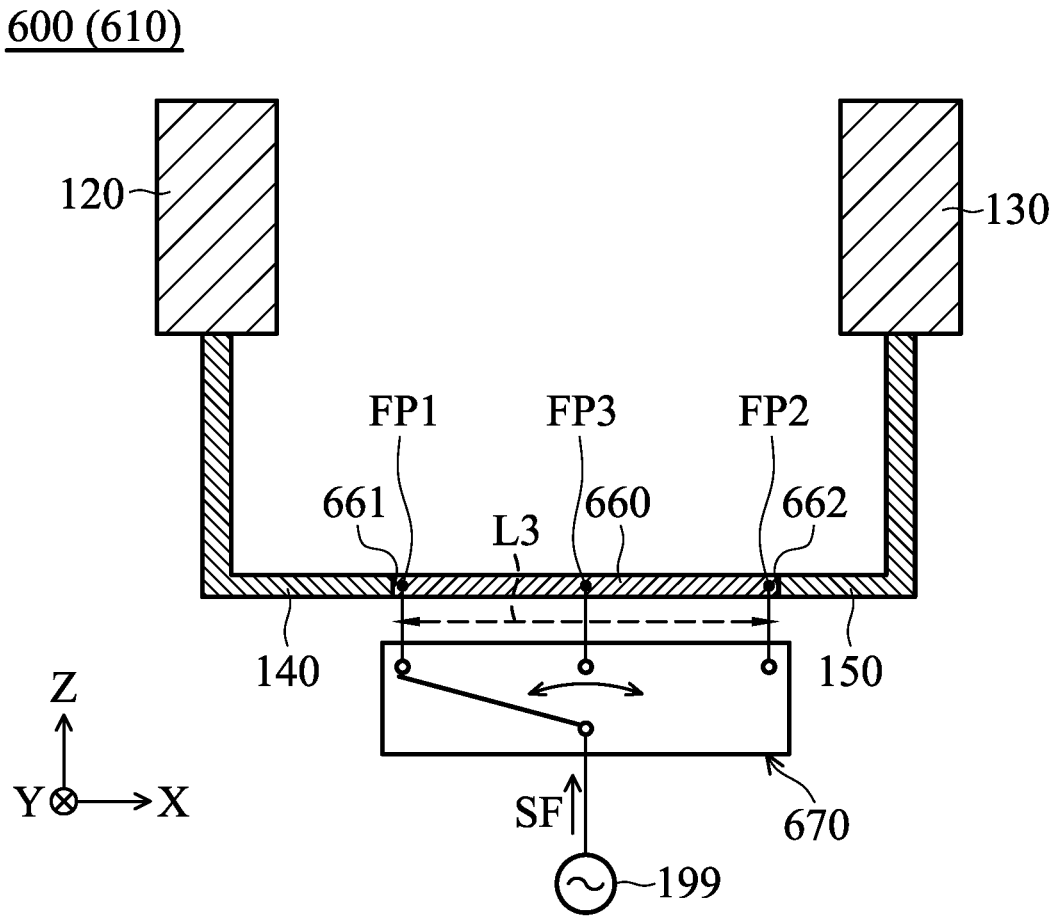
FIG. 6 is a diagram of an antenna system according to another embodiment of the invention.

FIG. 6 is a diagram of an antenna system 600 according to another embodiment of the invention. FIG. 6 is similar to FIG. 1. In the embodiment of FIG. 6, the antenna system 600 includes a first tunable antenna 610. The first tunable antenna 610 includes a first radiation element 120, a second radiation element 130, a transmission line, and a switch circuit 670. The aforementioned transmission line includes a first segment 140, a second segment 150, and a phase-adjustment segment 660. The phase-adjustment segment 660 has a first end 661 and a second end 662. The first radiation element 120 is coupled through the first segment 140 to a first feeding point FP1 at the first end 661 of the phase-adjustment segment 660. The second radiation element 130 is coupled through the second segment 150 to a second feeding point FP2 at the second end 662 of the phase-adjustment segment 660. The aforementioned transmission line (including the first segment 140, the second segment 150, and the phase-adjustment segment 660) may be a microstrip line, a stripline, or a CPW (Coplanar Waveguide). The structures and functions of the first radiation element 120, the second radiation element 130, the first segment 140, the second segment 150, and the signal source 199 have been described in the embodiments of FIG. 1 and FIG. 2.

The phase-adjustment segment 660 may substantially have a straight-line shape. The length L3 of the phase-adjustment segment 660 may be shorter than or equal to 0.25 wavelength ($\lambda/4$) of a central frequency of an operation frequency band of the antenna system 600, so as to provide a feeding phase difference which is almost equal to 90 degrees. A third feeding point FP3 is positioned at a central point of the phase-adjustment segment 660 (e.g., the central point between the first feeding point FP1 and the second feeding point FP2). The switch circuit 670 is configured to switch between the first feeding point FP1, the second feeding point FP2, and the third feeding point FP3, such that the signal source 199 is coupled through the switch circuit 670 to the first feeding point FP1, the second feeding point FP2, or the third feeding point FP3. Accordingly, the first feeding point FP1, the second feeding point FP2, or the third feeding point FP3 is arranged for receiving a feeding signal SF from the signal source 199. Similarly, as mentioned in the embodiment of FIG. 2, a respective capacitor may be coupled between any terminal of the switch circuit 670 and any of the first feeding point FP1, the second feeding point FP2, the third feeding point FP3, and the signal source 199, so as to block DC noise and prevent it from entering the first radiation element 120 and the second radiation element 130. By switching between the first feeding point FP1, the second feeding point FP2, and the third feeding point FP3, the first tunable antenna 610 can generate different radiation patterns due to the changes in feeding phases, and therefore it can receive or transmit wireless signals in a variety of directions.

Figure 7A:
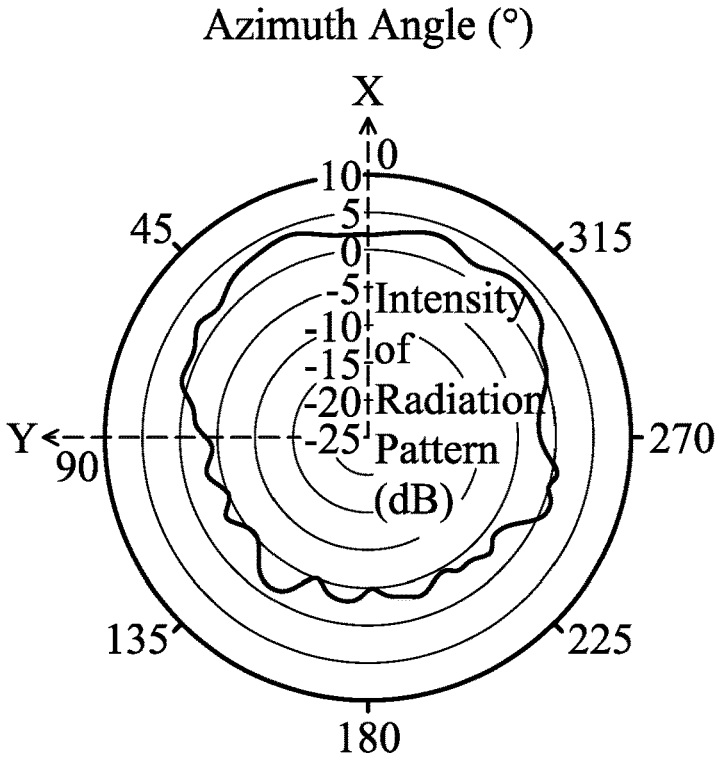
FIG. 7A is a synthetic radiation pattern of an antenna system according to an embodiment of the invention.
Figure 7B:
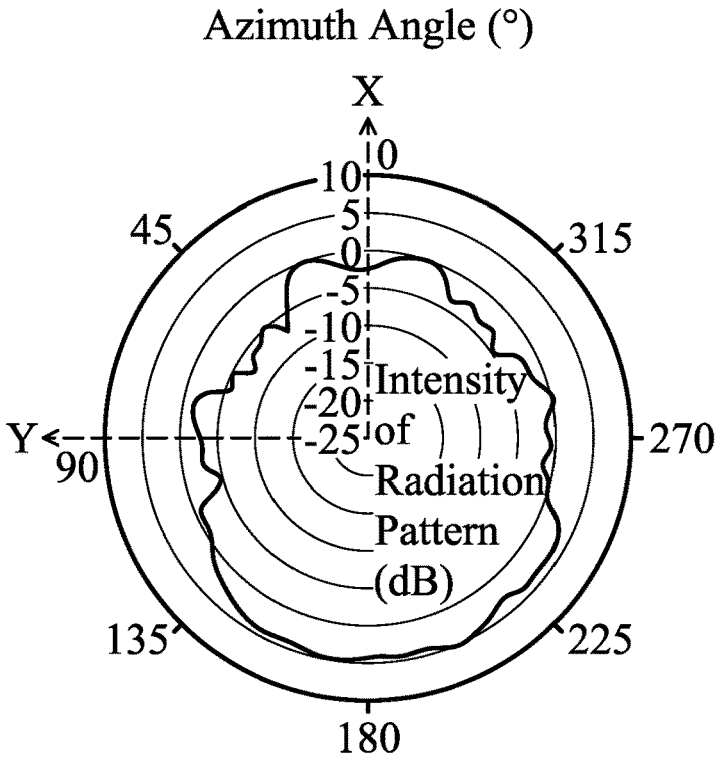
FIG. 7B is a synthetic radiation pattern of an antenna system according to an embodiment of the invention.
Figure 7C:
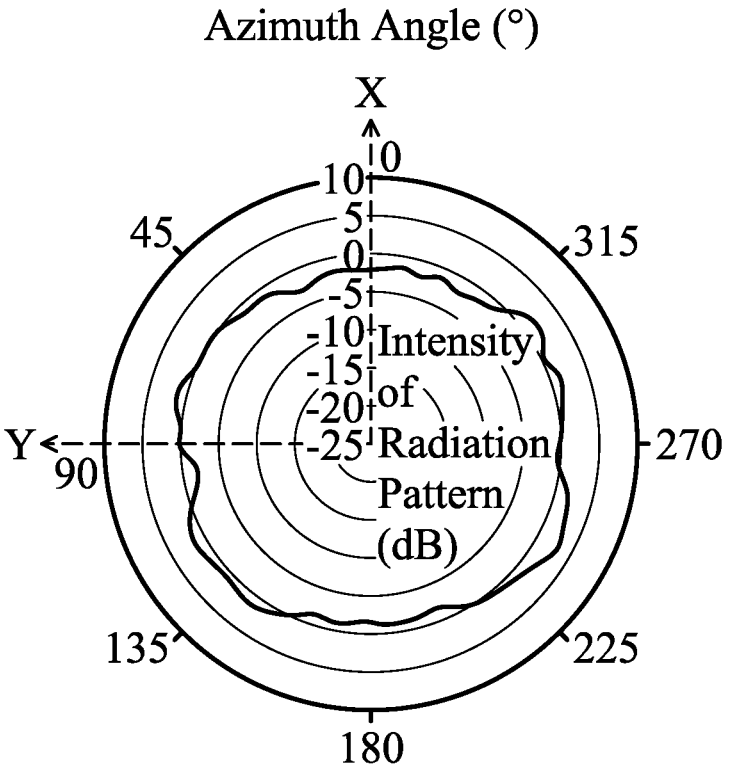
FIG. 7C is a synthetic radiation pattern of an antenna system according to an embodiment of the invention.

Please refer to FIG. 4 again. In some embodiments, each of the first tunable antenna 411 and the second tunable antenna 412 has the same structure as that of the first tunable antenna 610 of FIG. 6, thereby generating different synthetic radiation patterns. FIG. 7A is a synthetic radiation pattern of the antenna system 400 according to an embodiment of the invention, which is measured on the XY-plane. In the embodiment of FIG. 7A, the first tunable antenna 411 switches to its first feeding point, and the second tunable antenna 412 switches to its first feeding point, so as to enhance the intensity of radiation pattern in the direction of the +X axis (or the 0-degree azimuth). FIG. 7B is a synthetic radiation pattern of the antenna system 400 according to an embodiment of the invention, which is measured on the XY-plane. In the embodiment of FIG. 7B, the first tunable antenna 411 switches to its second feeding point, and the second tunable antenna 412 switches to its second feeding point, so as to enhance the intensity of radiation pattern in the direction of the −X axis (or the 180-degree azimuth). FIG. 7C is a synthetic radiation pattern of the antenna system 400 according to an embodiment of the invention, which is measured on the XY-plane. In the embodiment of FIG. 7C, the first tunable antenna 411 switches to its third feeding point, and the second tunable antenna 412 switches to its third feeding point, so as to uniform the intensity of radiation pattern over all directions. According to the measurements of FIGS. 7A to 7C, the antenna system 400 can generate three different synthetic radiation patterns by switching between the first feeding point, the second feeding point, and the third feeding point of each of the first tunable antenna 411 and the second tunable antenna 412 (whose practical structures may be the same as that of the first tunable antenna 610 of FIG. 6). It should be noted that the invention is not limited to the above. In other embodiments, the antenna system 400 includes more tunable antennas for generating more different synthetic radiation patterns.

In some embodiments, the third feeding point FP3 and the three-to-one switch circuit 670 of FIG. 6 are applicable to the first tunable antenna 110 of FIG. 1 or the first tunable antenna 310 of FIG. 3A and FIG. 3B. Therefore, the antenna systems 100 and 300 can generate more different radiation patterns.

In some embodiments, the aforementioned switch circuit performs a process for selecting a feeding point according to a control signal. The control signal may be generated by a processor module. For example, the processor module can control the switch circuit to switch to all of the feeding point combinations one after another, and finally select a specific feeding point combination corresponding to the maximum RSSI (Received Signal Strength Indicator), thereby optimizing the communication quality of the antenna system. The processor module can be implemented by a hardware circuit or by executing a computer software program. For example, the processor module may be a Wi-Fi module, and its control signal may be transmitted through a GPIO (General-Purpose Input/Output) interface to the switch circuit, but they are not limited thereto.

The invention proposes a novel antenna system for switching between feeding points, such that its one or more tunable antennas can generate different radiation patterns. Specifically, the invention can equalize the RSSI of each tunable antenna, so as to increase the throughput of the whole antenna system. According to the practical measurement, if the antenna system 400 of FIG. 4 is implemented with two first tunable antennas 110 of FIG. 1, the null of the radiation pattern of the antenna system 400 will be enhanced by about 69% to about 633%, and the average data transmission rate of the antenna system 400 will be increased by about 22% to about 90%; furthermore, if the antenna system 400 of FIG. 4 is implemented with two first tunable antennas 610 of FIG. 6, the null of the radiation pattern of the antenna system 400 will be enhanced by about 56%, and the average data transmission rate of the antenna system 400 will be increased by about 22%. The above improvement can meet the requirements of practical applications of general mobile communication devices.

Note that the above element sizes, element shapes, and frequency ranges are not limitations of the invention. An antenna designer can fine-tune these settings or values according to different requirements. It should be understood that the antenna system of the invention is not limited to the configurations of FIGS. 1-7. The invention may merely include any one or more features of any one or more embodiments of FIGS. 1-7. In other words, not all of the features displayed in the figures should be implemented in the antenna system of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna system, comprising:

a first tunable antenna, comprising:

a transmission line, comprising a first segment, a second segment, and a phase-adjustment segment;

a first radiation element, wherein the first radiation element is coupled through the first segment to a first feeding point;

a second radiation element, wherein the second radiation element is coupled through the second segment to a second feeding point; and a switch circuit, configured to switch between the first feeding point and the second feeding point, so that the first feeding point or the second feeding point is arranged for receiving a feeding signal;

where in the phase-adjustment segment has a first end and a second end, the first feeding point is positioned at the first end of the phase-adjustment segment, and the second feeding point is positioned at the second end of the phase-adjustment segment;

wherein the phase-adjustment segment substantially has an inverted U-shape;

wherein the switch circuit is at least partially disposed in a notch of the inverted U-shape of the phase-adjustment segment.

2. The antenna system as claimed in claim 1, wherein the first tunable antenna generates different radiation patterns by switching between the first feeding point and the second feeding point.

3. The antenna system as claimed in claim 1, wherein each of the first radiation element and the second radiation element substantially has a straight-line shape or an L-shape.

4. The antenna system as claimed in claim 1, wherein the antenna system covers an operation frequency band from 5150 MHz to 5875 MHz.

5. The antenna system as claimed in claim 4, wherein a length of the phase-adjustment segment is shorter than or equal to 0.25 wavelength of a central frequency of the operation frequency band.

6. The antenna system as claimed in claim 4, wherein a distance between the first radiation element and the second radiation element is substantially equal to 0.25 wavelength of a central frequency of the operation frequency band.

7. The antenna system as claimed in claim 4, wherein a length of each of the first radiation element and the second radiation element is substantially equal to 0.25 wavelength of a central frequency of the operation frequency band.

8. The antenna system as claimed in claim 1, wherein the switch circuit comprises:

an SPDT (Single Port Double Throw) switch, having a common terminal, a first terminal, and a second terminal, wherein the common terminal of the SPDT switch is coupled to a signal source, the first terminal of the SPDT switch is coupled to the first feeding point, and the second terminal of the SPDT switch is coupled to the second feeding point.

9. The antenna system as claimed in claim 8, wherein the switch circuit further comprises:

a first capacitor, coupled between the signal source and the common terminal of the SPDT switch;

a second capacitor, coupled between the first feeding point and the first terminal of the SPDT switch; and a third capacitor, coupled between the second feeding point and the second terminal of the SPDT switch.

10. The antenna system as claimed in claim 1, wherein the first tunable antenna further comprises:

a dielectric substrate, having a top surface and a bottom surface, wherein the first radiation element and the second radiation element are disposed on the top surface of the dielectric substrate;

a metal trace, disposed on the top surface of the dielectric substrate; and a ground plane, disposed on the bottom surface of the dielectric substrate;

wherein the transmission line is a microstrip line formed by the metal trace and the ground plane.

11. An antenna system, comprising:

a first tunable antenna, comprising:

a transmission line, comprising a first segment, a second segment, and a phase-adjustment segment;

a first radiation element, wherein the first radiation element is coupled through the first segment to a first feeding point;

a second radiation element, wherein the second radiation element is coupled through the second segment to a second feeding point; and a switch circuit, configured to switch between the first feeding point and the second feeding point, so that the first feeding point or the second feeding point is arranged for receiving a feeding signal;

where in the phase-adjustment segment has a first end and a second end, the first feeding point is positioned at the first end of the phase-adjustment segment, and the second feeding point is positioned at the second end of the phase-adjustment segment, wherein the first tunable antenna further comprises:

a dielectric substrate, having a top surface and a bottom surface, wherein the first radiation element and the second radiation element are disposed on the top surface of the dielectric substrate;

a metal trace, disposed on the top surface of the dielectric substrate; and a ground plane, disposed on the bottom surface of the dielectric substrate;

wherein the transmission line is a microstrip line formed by the metal trace and the ground plane, wherein the ground plane substantially has an inverted T-shape.

12. The antenna system as claimed in claim 10, wherein the metal trace has a vertical projection on the bottom surface of the dielectric substrate, and the whole vertical projection of the metal trace is inside the ground plane.

13. The antenna system as claimed in claim 1, wherein the phase-adjustment segment substantially has a straight-line shape.

14. The antenna system as claimed in claim 1, wherein a third feeding point is further positioned at a central point of the phase-adjustment segment, and the switch circuit is further configured to switch between the first feeding point, the second feeding point, and the third feeding point, so that the first feeding point, the second feeding point, or the third feeding point is arranged for receiving the feeding signal.

15. The antenna system as claimed in claim 1, further comprising:

a second tunable antenna, wherein the second tunable antenna and the first tunable antenna have identical structures.

16. The antenna system as claimed in claim 15, wherein the first tunable antenna and the second tunable antenna are respectively disposed at two opposite corners of a display device of a mobile device.

17. The antenna system as claimed in claim 16, wherein the mobile device is a notebook computer.

18. The antenna system as claimed in claim 15, wherein the first tunable antenna and the second tunable antenna generate different synthetic radiation patterns.

* * * * *